US007661350B2

(12) United States Patent
Bouet

(10) Patent No.: US 7,661,350 B2
(45) Date of Patent: Feb. 16, 2010

(54) MODULE STRUCTURE FOR ELECTRICAL ARMOUR PLATING

(75) Inventor: Thierry Bouet, Orleans (FR)

(73) Assignee: TDA Armenents SAS, Laferte Saint Aubin (FR)

( * ) Notice: Subject to any disclaimer, the term of this patent is extended or adjusted under 35 U.S.C. 154(b) by 307 days.

(21) Appl. No.: 11/365,602

(22) Filed: Mar. 2, 2006

(65) Prior Publication Data

US 2006/0196350 A1 Sep. 7, 2006

(30) Foreign Application Priority Data

Mar. 4, 2005 (FR) ..... 05 02210

(51) Int. Cl.
*F41H 5/02* (2006.01)

(52) U.S. Cl. ..... 89/36.02; 89/36.01; 89/36.17

(58) Field of Classification Search ..... 89/36.01, 89/36.02, 36.17; 428/911
See application file for complete search history.

(56) References Cited

U.S. PATENT DOCUMENTS

| | | | | |
|---|---|---|---|---|
| 3,591,248 | A * | 7/1971 | Meunier et al. | 359/360 |
| 5,650,208 | A * | 7/1997 | Chaussade et al. | 428/38 |
| 5,723,811 | A | 3/1998 | Bouet et al. | |
| 6,758,125 | B1 * | 7/2004 | Zank | 89/36.17 |
| 6,787,204 | B2 * | 9/2004 | Chaussade et al. | 428/34 |
| 7,104,178 | B1 * | 9/2006 | Zank | 89/36.17 |
| 2004/0118273 | A1 | 6/2004 | Zank | |

FOREIGN PATENT DOCUMENTS

| | | | |
|---|---|---|---|
| DE | 4034401 | A1 | 4/1992 |
| DE | 4034401 | A1 | 4/1992 |
| DE | 4244546 | A1 | 5/1998 |
| DE | 4244546 | A1 | 5/1998 |
| DE | 3715807 | C1 | 12/1998 |
| DE | 3715807 | C1 | 12/1998 |

* cited by examiner

*Primary Examiner*—Michelle Clement
(74) *Attorney, Agent, or Firm*—Lowe Hauptman Ham & Berner, LLP

(57) ABSTRACT

The invention relates to the field of the protection of structures such as terrestrial buildings, vehicles or else ships, against attacks operated by means of hollow charges. It applies in particular to the protection of armoured vehicles.

The subject of the invention is a module for embodying a lightweight and mobile reactive armour comprising at least one electrically conducting external wall and one electrically conducting internal wall and forming two electrodes between which is applied a very high voltage, the said walls defining an inter-electrode space, as well as an electrically conducting internal tridimensional mechanical structure, of low density, in electrical contact with the internal wall.

The module according to the invention is intended to be placed between the object to be protected and the hollow charge, the internal tridimensional mechanical structure being positioned between the electrodes and the object to be protected.

The module according to the invention makes it possible to increase the effectiveness the destruction of the jet by lengthening the destruction by fusion and vaporization during the traversal of the internal tridimensional mechanical structure.

17 Claims, 7 Drawing Sheets

MODULE STRUCTURE FOR ELECTRICAL ARMOUR PLATING

FIELD OF THE INVENTION

The invention relates to the field of the protection of structures such as terrestrial building, vehicles or else ships, against attacks operated by means of hollow charges. It applies in particular to the protection of armoured vehicles.

BACKGROUND OF THE INVENTION

As illustrated in FIG. 1, a hollow charge constitutes, in a known manner, the destructive part of a projectile intended for the perforation of armour elements. This hollow charge comprises several elements.

Chiefly these are a priming element 13, a shield 14 and an explosive element 12. The whole assembly is packaged in a casing 11 closed off at one of its ends by the part 15, called the liner, intended to penetrate the armour attacked.

The liner 15, generally of substantially conical shape, is made of metal such as copper for example.

Upon the firing of the charge and under the action of the explosive, the liner 15 acquires a very significant kinetic energy and is imbued with a very significant and very fast expansion. Under the effect of this very significant deformation it takes the shape illustrated by FIG. 2. The liner then comprises two parts, a rear part 21 called the core and a front part 22 called the jet.

The jet represents the perforating part of the charge. Its dimensions and in particular the length are expanding according to a velocity gradient, the tip of the jet 23 being propelled at a velocity of around 8000 m/s, the tail of the jet 24 having a velocity of around 3000 m/s. The core 21 is for its part propelled at a velocity of around 1000 m/s.

As illustrated in FIG. 1, the jet 22 takes the form of a long rod of melting metal, with a diameter of the order of 2 mm, the surface of which exhibits, as shown by the enlargement, a slightly annulated appearence with bulges 26 and constrictions 25.

In the course of the motion the core tends to take a flattened shape whose dimensions, significant with respect to the diameter of the jet are such that it hardly participates in the perforation.

On account of the kinetic energy that it possesses, the jet is capable of penetrating metal armour several decimetres thick. Effective inert protection against projectiles equipped with a hollow charge therefore consists in increasing the thickness of the armour and therefore turns out to be very penalizing in terms of weight.

To protect mobile structures, such as armoured vehicles, against such projectiles, while avoiding an excessive weight increase, it known to use electrical devices whose aim is to destructure the jet as rapidly as possible during its penetration by disintegrating it.

For this purpose, a known principle consists in implementing a structural destabilization of the jet (breakup), associated with melting/vaporization under the effect of the passage of an electric current, the melting of the jet being the predominant effect in the neutralization of the hollow charge. This known principle is illustrated by FIG. 3.

According to this known principle, the protective structure implemented consists essentially of two metal plates placed on the surface to be protected and constituting two electrodes connected to a battery of charged capacitors which apply a very high voltage between the two plates. When the hollow charge jet develops, it short-circuits the two electrodes and a very intense current is established progressively in the metal jet. The effect of this current is to heat the jet up to vaporization.

To ensure total effectiveness, it is necessary for the destruction of the jet to take place during its passage between the two electrodes. The elements of the jet having crossed the space between the two plates without damage are no longer subjected to the electric current and are therefore no longer liable to be destroyed. This is true in particular for the beginning of the jet. They may therefore cause damage, the protection then being partially ineffective.

Given that the jet penetrates the structure at very high velocity, it is readily appreciated that the success of the destruction of the jet depends on the energy imparted by the Joule effect and on the time taken to impart this energy to the jet. This energy is in practice proportional to the square of the intensity of the current and to the duration of passage between the two electrodes.

Thus, at the beginning of penetration, the maximum current is not established on account of the stray inductive elements present in the circuit constituted by the plates and the jet. The intensity of the current which then flows around the jet is weak so that the head of the jet is not destroyed. The known principle of the prior art does not therefore ensure complete destruction of the charge and leaves intact the part with the most energy which may carry out its perforation function without encountering a complete obstacle.

To alleviate this problem a certain number of solutions have been envisaged. The objective being to allow a current to flow around the jet head after the latter has left the space between the plates.

A first solution envisaged consists in installing a massive metal structure behind the earth electrode and linked electrically to the latter. The drawback of such a solution is the weight of the structure thus formed, hardly compatible for example with a mobile structure of armoured vehicle type.

Another solution illustrated by FIG. 4 consists in the placing in abutment with the internal plate of a structure made of metal plates disposed in parallel planes perpendicular to the plane of the plate. This architecture, much lighter than that described previously, allows a current to be made to flow around the head of the jet after the latter has left the space between the two plates. On the other hand, its effectiveness depends on the orientation of the jet with respect to the plane defined by the plates and the spacing of the plates with respect to one another. Likewise the intensity of the current established between the jet head and one or other plate is dependent on this separation and on the diameter of the jet and the position of the jet with respect to one or other plate. As far as this architecture is concerned the illustration of FIG. 4 corresponds however to a favourable case where the jet progresses between two plates, the distance between these plates being suitably adjusted with respect to the diameter of the jet. In order to get close to this favourable case as often as possible, it is necessary for the structure to comprise a large number of plates close together, thus reviving the problem of the weight of the whole assembly.

SUMMARY OF THE INVENTION

To alleviate the drawbacks of the prior art, it is therefore appropriate to define a lightweight structure, making it possible to produce the melting of the jet head and the effectiveness of which depends little or not at all on the direction of penetration of the hollow charge with respect to the orientation of the structure. For this purpose the subject of the invention is a module for embodying a lightweight and mobile reactive armour comprising at least one electrically conducting external wall and one electrically conducting internal wall and forming two electrodes between which is applied a very high voltage, the said walls defining an inter-electrode space as well as an electrically conducting internal tridimensional mechanical structure, of low density, in electrical contact with the internal wall. The module according to the invention is intended to be placed between the object to be protected and the hollow charge, the internal tridimensional mechanical structure being positioned between the electrodes and the object to be protected.

According to a first embodiment the internal mechanical structure is embodied by means of a plurality of overlaid corrugated conducting sheets, each sheet being separated from the neighbouring sheets by a space of given thickness and having a side linked electrically to the intermediate wall, the axis of the corrugations being parallel to the plane defined by the said intermediate wall.

According to the invention, the planes formed by each of the corrugated conducting sheets cut the plane formed by the intermediate wall at a right angle or at an angle $\alpha$ of less than $\pi/2$ According to another preferred embodiment the internal mechanical structure comprises two juxtaposed structures each structure is embodied by means of a plurality of overlaid corrugated conducting sheets, each sheet being separated from the neighbouring sheets by a space of given thickness and having a side linked electrically to the internal wall, the axis of the corrugations being parallel to the plane defined by the said internal wall, the planes in which the corrugated conducting sheets are disposed cut the plane formed by the internal wall at an angle $\alpha_1$ of less than $\pi/2$ for the first structure and an angle $\alpha_2$ of more than for the second structure.

According to this embodiment, $\alpha_2$ and $\alpha 1$ are chosen arbitrarily, where $\alpha_2=\pi-\alpha_1$.

According to another embodiment, the internal mechanical structure exhibits a honeycomb type shape comprising a plurality of cellular ducts, the said structure being linked electrically to the internal wall, the axis of each cellular duct cutting the plane defined by the internal wall at an angle $\alpha$.

According to this embodiment $\alpha$ is arbitrary, or $\alpha$ is different from $\pi/2$ According to another embodiment the internal mechanical structure is embodied by means of a wool made of fibres of electrically conducting material, linked electrically to the internal wall.

According to another embodiment the internal mechanical structure is embodied by means of a foam of electrically conducting material, linked electrically to the internal wall.

The subject of the invention is also a device for protection against hollow charges comprising module elements as claimed.

BRIEF DESCRIPTION OF THE DRAWINGS

Other characteristics and advantages will become apparent following the thread of the description which makes reference to the appended drawings which represent.

DETAILED DESCRIPTION

In order to clearly elucidate the advantages afforded by the module according to the invention, it is appropriate to analyse the manner of operation of a hollow charge. This manner of operation, known elsewhere, is presented here in a very general way.

Figure 1:
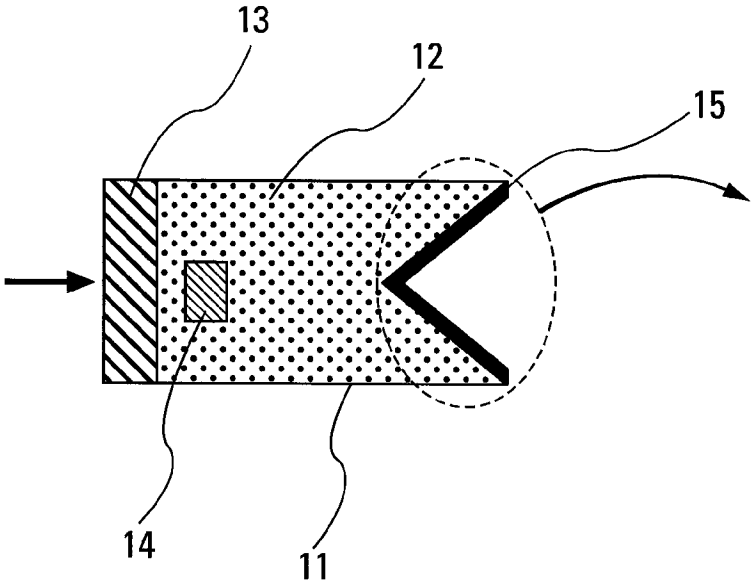
Fig. 1 Prior Art
FIG. 1: the schematic representation of a hollow charge before firing.

FIG. 1 presents in a schematic manner the structure of a hollow charge at rest. This charge consists of a body 11, substantially cylindrical for example, enclosing an explosive 12. At one of its ends is placed a priming device 13 and an internal element 14, or a shield, intended to shape the detonation wave created by the primer.

At the opposite end, the body of the charge is closed off by an element 15, of substantially conical shape, called the liner. The liner is generally made of metal, copper for example. It constitutes a cone whose base has a diameter of the order of a decimetre and whose wall has a thickness of the order of an mm.

Figure 2:
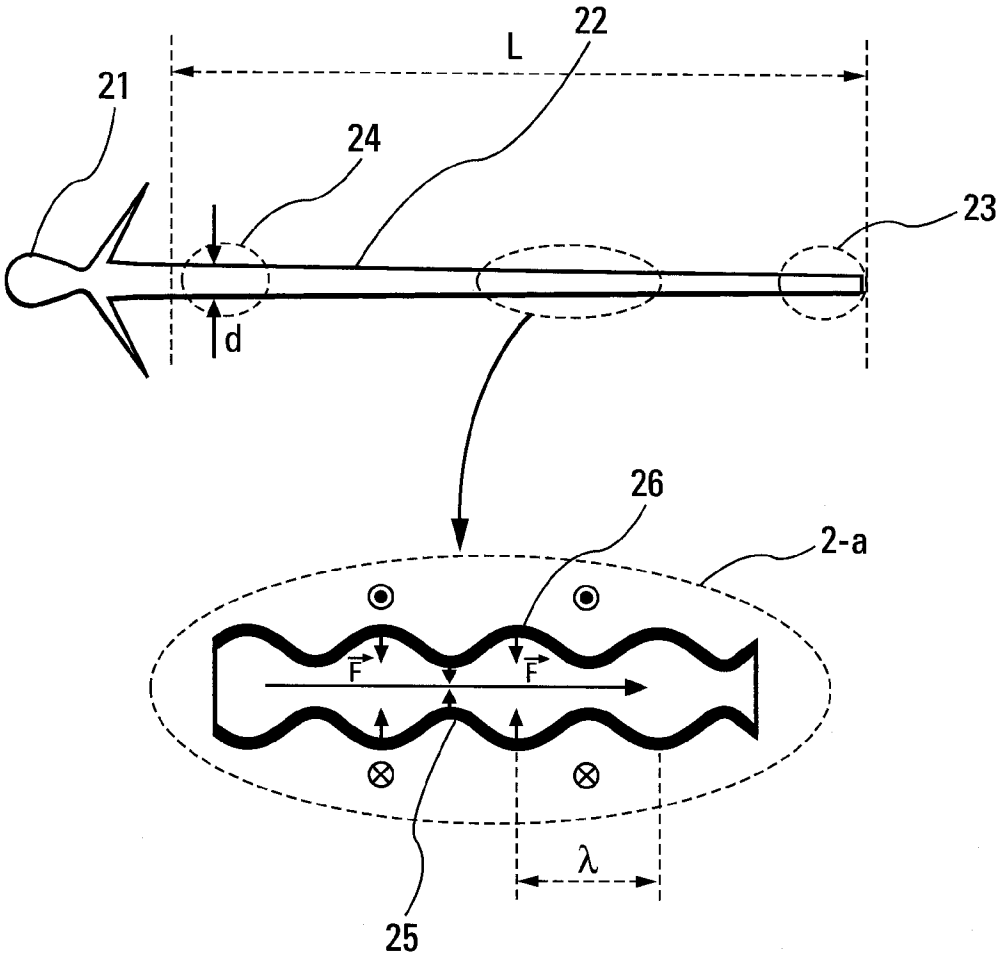
Fig. 2 Prior Art
FIG. 2: the schematic representation of the same hollow charge after firing.

FIG. 2 schematically presents the appearance and the structure of the charge after firing. Firing is achieved by triggering of the priming device 13 which generates a detonation wave that explodes the explosive 12 contained in the body 11 of the charge. Under the effect of the explosion, the liner 15 is expelled with a very significant kinetic energy. The propulsion of the liner is accompanied by a deformation of the said liner which takes the shape illustrated by FIG. 2. The liner then takes the form of an elongate object, subjected to a velocity gradient causing it to stretch increasingly over time. The liner thus deformed thus constitutes a perforating projectile consisting of two parts. The first part 21 constitutes what is called the core. The second part 22 called the jet constitutes the perforating part of the projectile, the part intended to penetrate the armour of the structure attacked, an armoured craft for example.

As illustrated by the figure, the jet takes the form of a long metal rod of a diameter d equal to a few mm and of a length of the order of a metre. It comprises a free end 23, or head, and an end linked to the core 24. The whole of the projectile is subjected to a significant velocity gradient: from 8000 m/s for the head of the jet to 3000 m/s for the end in contact with the core for example, the core for its part moving with a velocity of the order of 1000 m/s. Thus, the head of the jet moving at a greater velocity than that of the core the jet is subjected to an elongation.

As shown by the detailed view 2-*a*, the kinematics followed by the whole of the projectile implies that the surface of the jet shows a wavy appearance, made up of necks 25 and bulges 26.

The action of such a projectile against armour is related mainly to the very significant kinetic energy of the projectile. So that, even having a small mass and diameter, the projectile of the hollow charge has a very significant perforating capability. On account of its very large velocity it is moreover very difficult to neutralize.

Figure 3:
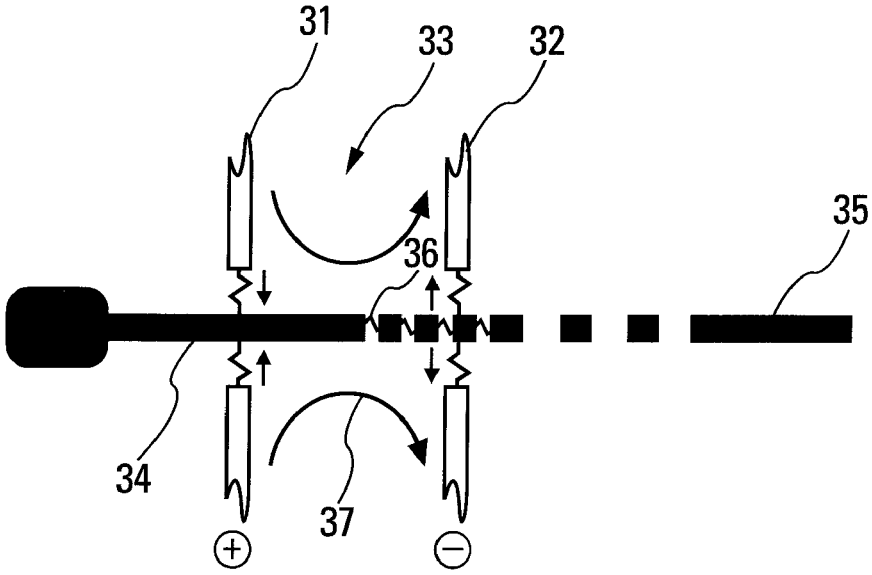
Fig. 3 Prior Art
FIG. 3: the illustration of the known principle of dynamic protection of the prior art.

FIG. 3 illustrates a general principle of protection known from the prior art, intended for attempting to neutralize just in time a hollow charge projectile. This principle consists in placing in front of the bulkhead of the object to be protected a module comprising two electrically conducting walls 31 and 32 separated by an empty space 33, the two walls being subjected to a very high potential difference by means of a high power supply. The direction of polarity is here immaterial and is indicated arbitrarily in FIG. 3.

When the hollow charge jet 34 develops, after having perforated the external wall 31 of the module, the jet head comes into contact with the internal wall 32. It then short-circuits the two electrodes constituting these two energized walls and a current is established progressively in the metal jet. As soon as the energy imparted to the jet by the passage of the current is sufficient, the jet is destroyed (vaporized) by the Joule effect. This effect is supplemented, as illustrated by the enlargement 2-*a* of FIG. 2, by a fracturing action exerted on the jet by the Laplace forces $\vec{F}$ engendered by the passage of the current I.

During the crossing phase of the jet, the electrical continuity between the various fragments of the jet is affected as much by discharges of potential as through the conducting plasma formed by the various segments of the already vaporized jet. In this figure this electrical continuity is represented by the symbols of resistors 36. The arrows 37 and 38 depict the passage of the current.

On account of the very significant velocity of the jet it is important that the passage of a significant current be established very rapidly in such a way that the destruction of the jet can be achieved before the head of the jet has been able to cross the internal wall. Specifically, it is known that the energy produced by the Joule effect is proportional to the square of the intensity of the current traversing the conductor, here the jet, and to the time of passage of the current.

The problem encountered when implementing such a principle known from the prior art resides mainly in the time to establish the current which traverses the jet 34 and the time to sustain this current which is dependent on the velocity of traversal of the space between the walls by the jet. Now, at the beginning of the phenomenon, when the head of the jet reaches the internal wall the intensity of the current which is established is low, the inductances of the electrical supply circuit opposing instantaneous establishment. Consequently, the current which crosses the jet having insufficient intensity, the head of the jet 35 is not destroyed. It therefore perforates the internal wall 32 and continues its destructive action.

Figure 4:
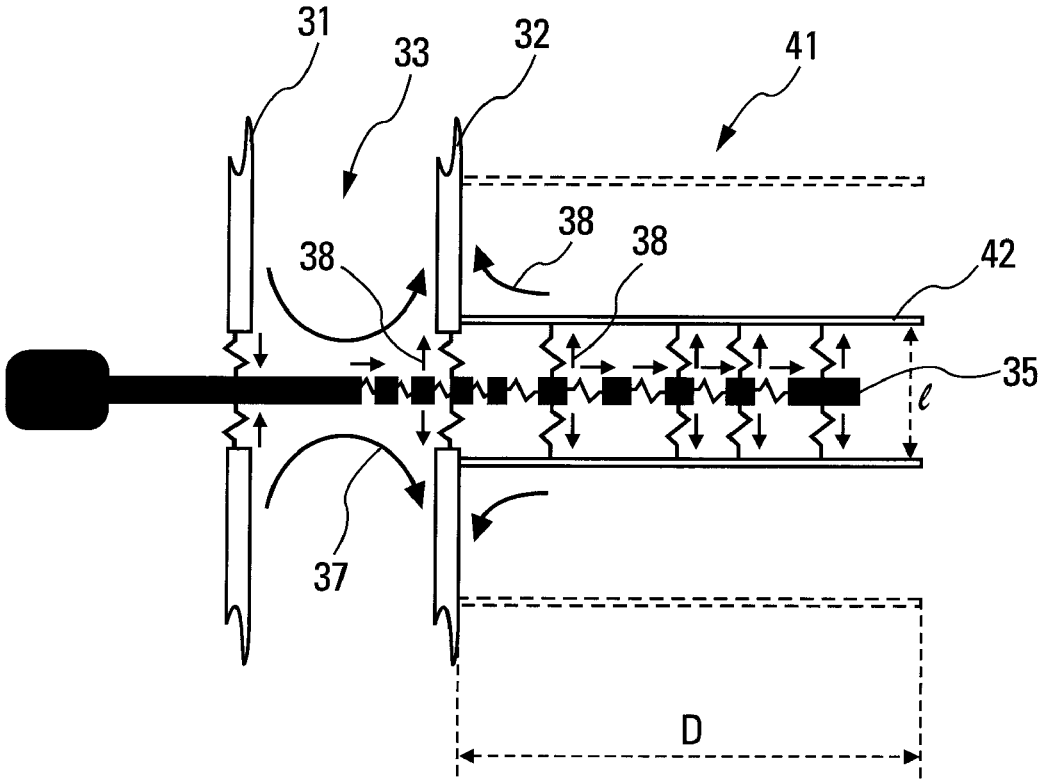
Fig. 4 Prior Art
FIG. 4: the illustration of an improvement of the process illustrated by FIG. 3, known from the prior art.

FIG. 4 illustrates a known means of the prior art making it possible to refine the known principle illustrated by FIG. 3. As shown by this figure, this improvement consists in adding to the system of electrodes described by FIG. 3 a structure 41 of width D, consisting of overlaid electrically conducting plates 42 of small thickness spaced apart from one another by a distance I. This structure 41 is applied to the face of the internal wall which does not overlook the intermediate space 33 and is in electrical contact with this wall.

The spacing d between the plates is chosen so as to promote the passage of an electric current by discharge of potential between the neighbouring plates of the jet and the jet itself. In FIG. 4, in order to render the whole assembly more clear, the ratio of scale between the jet and the size I of the spacing between plates is deliberately not complied with.

The refinement illustrated by FIG. 4 constitutes an improvement of the principle illustrated by FIG. 3, since it makes it possible to maintain the passage of an electric current through the jet head although the latter has already perforated the internal wall 32. It thus makes it possible to increase the destruction of the jet by melting and vaporization during the traversal of the structure 41. However, trials conducted in addition have highlighted a significant variation in the effectiveness of such a structure depending on the relative positioning of the jet with respect to the plates. Optimization of the structure is therefore difficult and leads to an unwieldy and bulky system if one is searching for complete protection.

Figure 5:
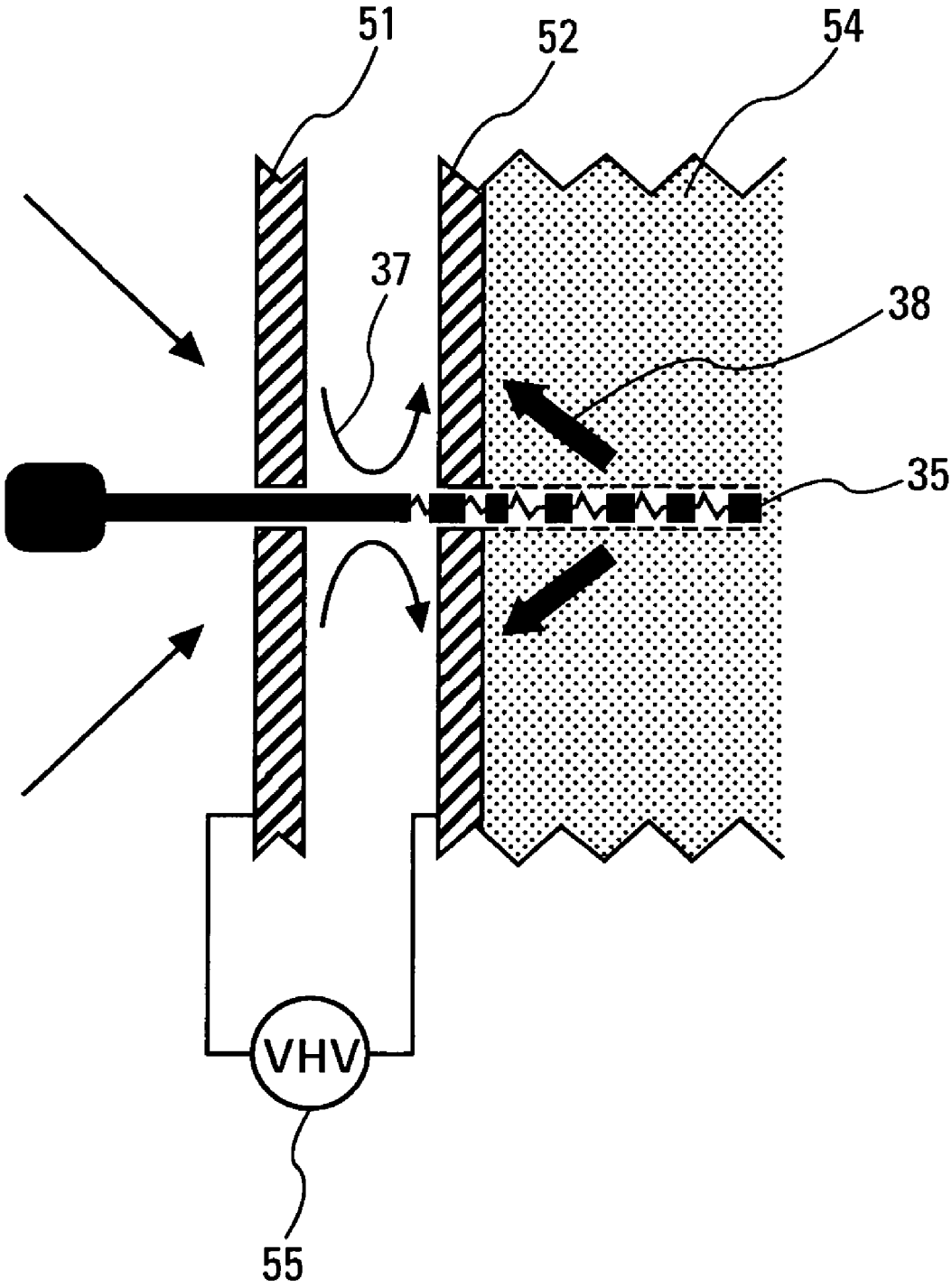
FIG. 5: the basic schematic of the structure of the module according to the invention.

FIG. 5 depicts in a very general manner the structure of the module according to the invention.

The module according to the invention comprises mainly two conducting walls, an external wall 51 and an internal wall 52, defining an intermediate space 53. The module also comprises an energy absorbing conducting internal structure 54 applied against the tridimensional wall 52 and linked electrically to this wall. According to the invention the internal structure 54 is a tridimensional lightweight structure. Between the two walls 51 and 52 is applied a very high voltage by means of a high power supply 55, the two walls thus constituting two electrodes.

The tridimensional structure 54 according to the invention advantageously makes it possible to obviate the drawback of the modules known from the prior art and illustrated by FIG. 4. Specifically, in contradistinction to a multi-plane structure such as that of FIG. 4, a tridimensional structure makes it possible to ensure quasi-continuous electrical interaction with the head of the hollow charge jet 35 in the course of its penetration into the structure 54, and to do so regardless of the direction of penetration of the projectile into the module. The action of the destructive current of the jet is thus prolonged. Its use therefore makes it possible to optimize the overall thickness and the weight of the module according to the invention.

Moreover, being as it is a structure whose elements are disposed along the three dimensions in space this structure can readily be adaptable to one or more predetermined types of hollow charges.

The subsequent description presents, by way of non-limiting examples, various alternative embodiments of a module comprising a tridimensional structure according to the invention.

Figure 6:
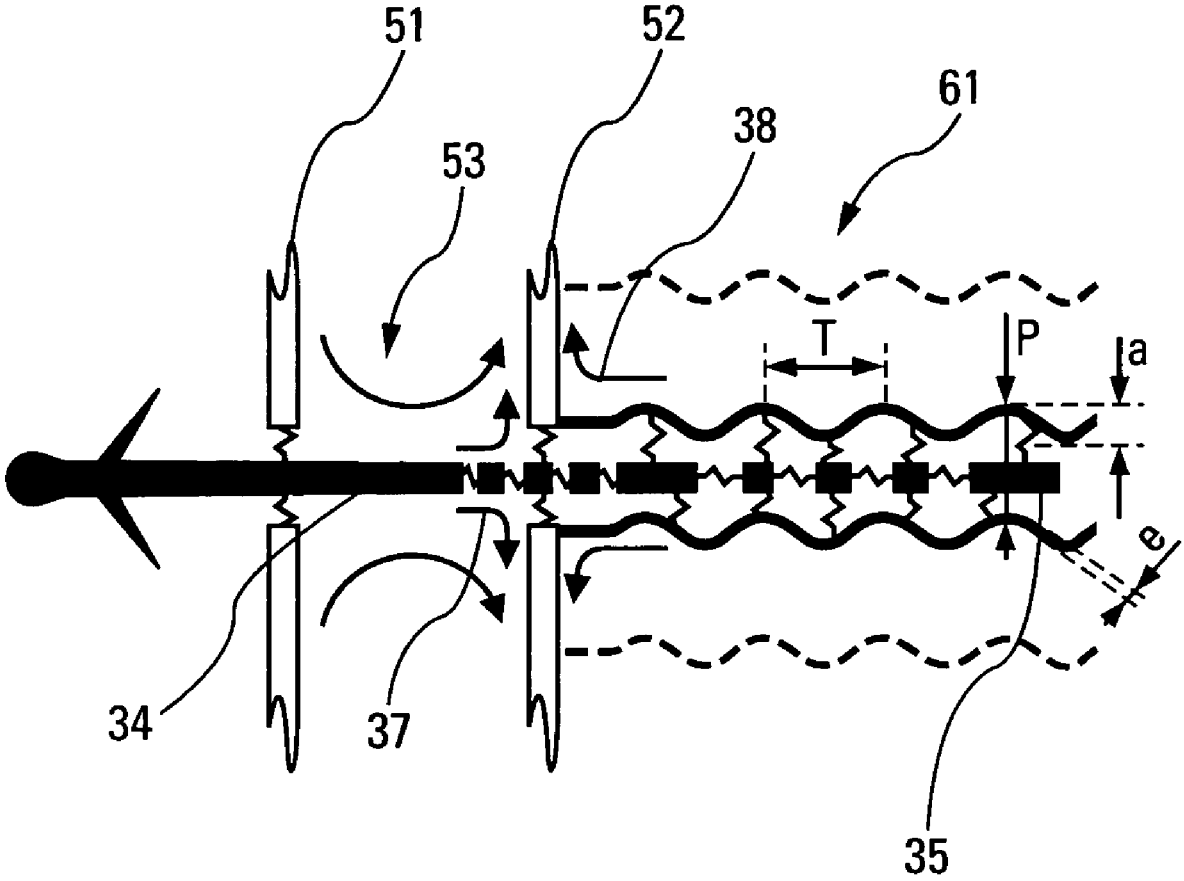
FIG. 6: the illustration of a first embodiment of the module according to the invention.

FIG. 6 presents a first simple embodiment of a three-dimensional structure according to the invention. In this embodiment the tridimensional structure consists of a superposition of conducting corrugated sheets or plates 62 disposed in planes perpendicular to the plane of the internal wall 52, the whole assembly of the structure being placed in electrical continuity with the wall 52. The corrugated plates have dimensions determined so as to optimize the interactions between the structure 61 and the jet which penetrates thereinto. Thus for a given type of projectile, the various dimensions are determined for example as follows:

The thickness e of each plate is of the order of magnitude of the thickness of skin around which the current flows. Within the framework of the applications generally envisaged, this thickness is less than an mm.

The spacing p between two consecutive plates is chosen to be of the order of magnitude of the diameter of a hollow charge jet, that is to say a few mm. This spacing makes it possible to obtain maximum electrical interaction between the jet and the closest plates 62, as well as a maximum fragmentation effect through the Laplace forces mentioned earlier.

The value of the amplitude a of the corrugation is chosen in such a way that the ratio between the spacing p and the amplitude an interaction between the jet and the neighbouring plates over the largest number of points, so as to ensure substantially continuous current passage. This condition is advantageously sufficient to ensure the destruction of the jet head before it traverses the structure 61 completely, regardless of the angle at which the hollow charge impacts the module.

The spacing T between 2 corrugations is chosen to be of the order of magnitude of the natural period of corrugation $\lambda$ of a hollow charge jet free of any interaction. $\lambda$ is typically of the order of a few mm.

It should be noted that for reasons of clarity of the figure, the relative dimensions of the plates 62 and of the jet 34 are deliberately not represented on the same scale, the dimensions of plates 62 being deliberately magnified.

The structure presented in FIG. 6 therefore represents a simple embodiment of a tridimensional structure capable of ensuring maximum electrical interaction between the hollow charge jet and the structure. By comparison with the solutions known from the prior art it has the advantage of enhanced effectiveness obtained at low cost by means of a relatively simple and lightweight structure.

Figure 7:
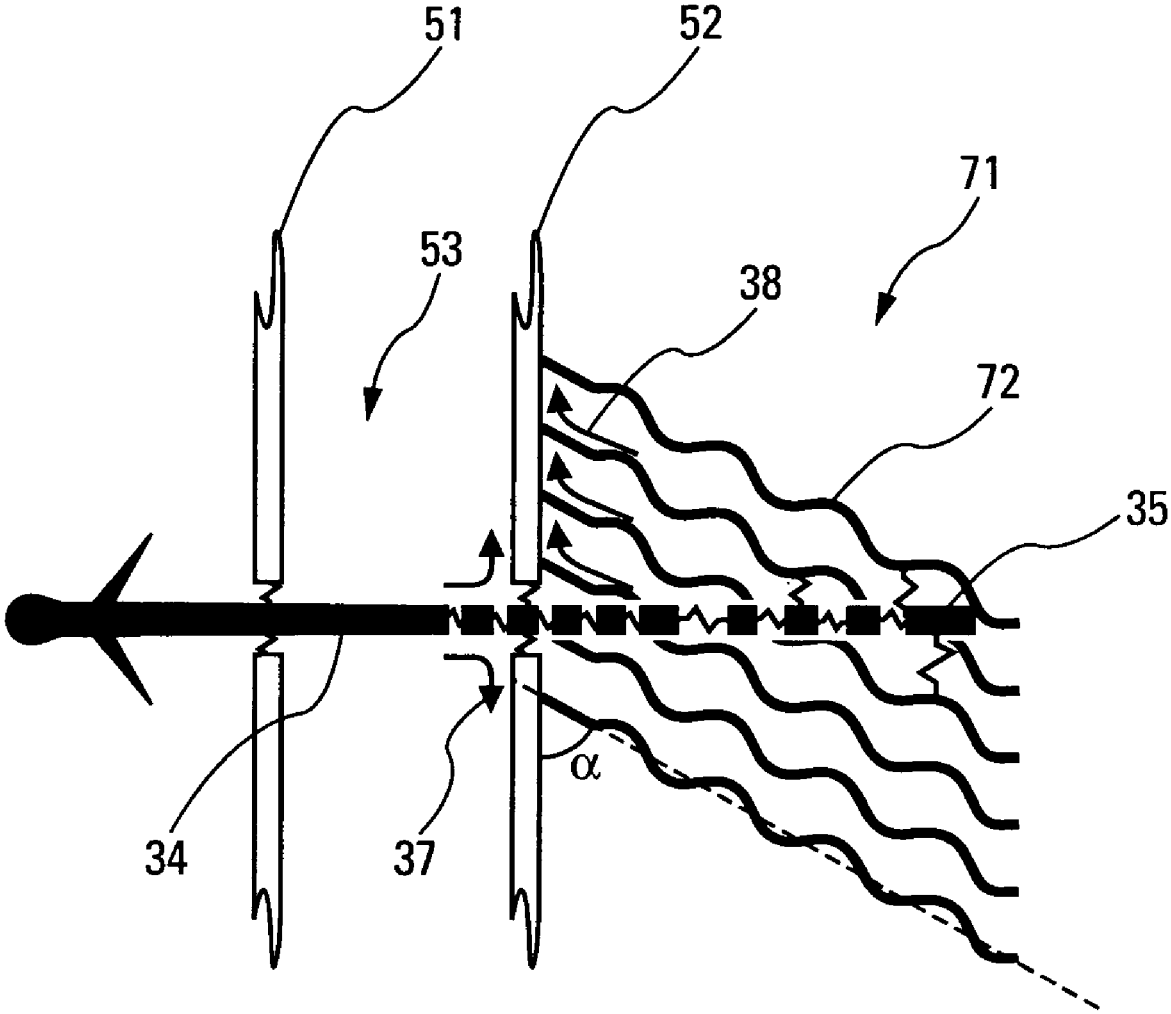
FIG. 7: the illustration of a variant of the embodiment illustrated by FIG. 6, FIG. 8: the illustration of a second embodiment of the module according to the invention.

FIG. 7 presents an alternative of the embodiment of the tridimensional structure of FIG. 6.

In this alternative embodiment, the corrugated plates 72 are disposed in parallel planes exhibiting an angle $\alpha$ substantially different from $\pi/2$ with the plane of the wall 52. This alternative of the previous embodiment makes it possible in particular to further increase, according to the angle of penetration of the hollow charge jet into the module, the number of interaction between the jet head 35 and the plates 72. It is thus advantageously possible to create, by choosing a particular angle $\alpha$, a structure 72 adapted to a given type of threat.

Figure 8:
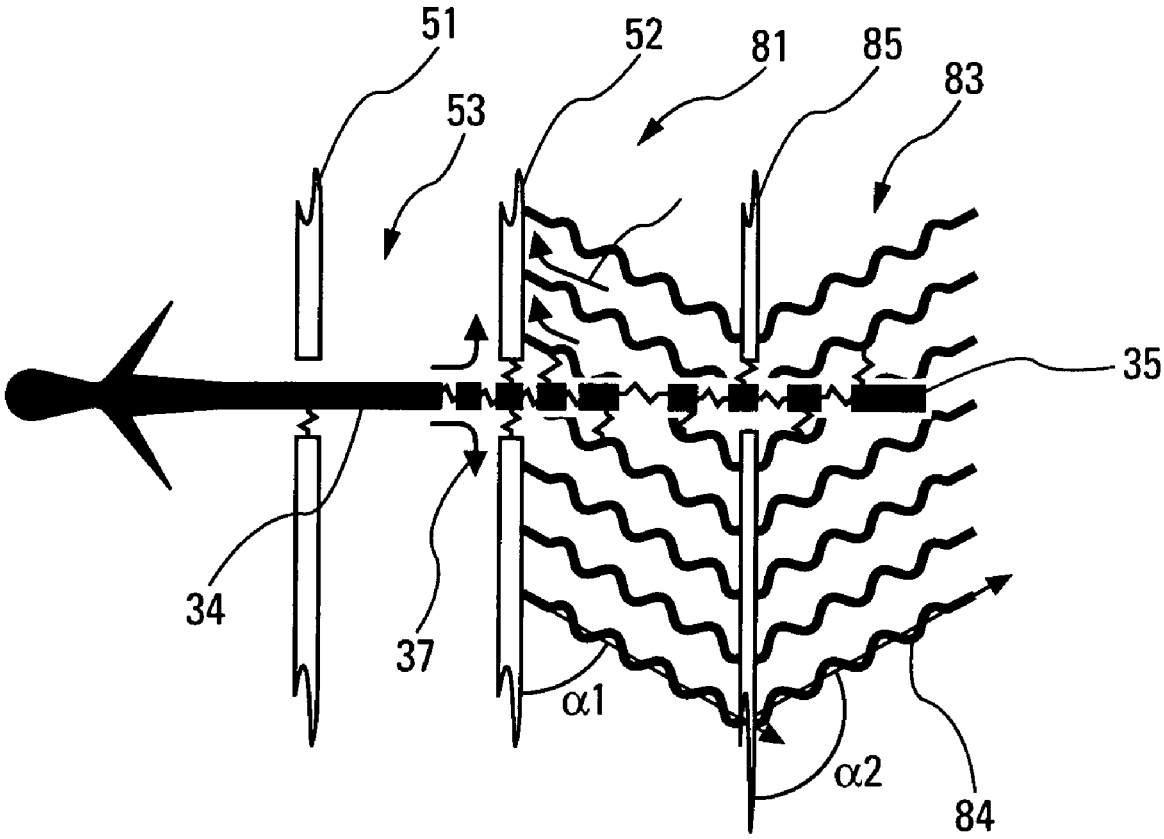

FIG. 8 presents a more complex alternative of the embodiment of the tridimensional structure of FIG. 6. This alternative consists in juxtaposing two corrugated structures similar to the structure 71 of FIG. 7, the two structures 81 and 83 possibly being, for ease of implementation, separated by a conducting bulkhead 85. The assembly of the two structures being disposed against the wall 52 and electrically linked to the latter. According to this alternative embodiment the planes along which the plates of the structure 81 are disposed exhibit an angle $\alpha_1$ substantially different from $\pi/2$ with the plane of the wall 52, whereas the planes along which the plates of the structure 83 are disposed exhibit an angle $\alpha_2$ different from $\alpha_1$, likewise substantially different from $\pi/2$, with the plane of the wall 52. It is for example possible to form a structure for which $\alpha_1$ and $\alpha_2$ are complementary. Such a structure, of more complex embodiment than the structures of FIGS. 6 and 7, has the advantage of remaining a lightweight structure and of offering wider protection as regards the gamut of projectile envisaged and as regards their directions of arrival.

To embody the tridimensional structure 54 according to the invention, it is possible to envisage other solutions.

Figure 9:
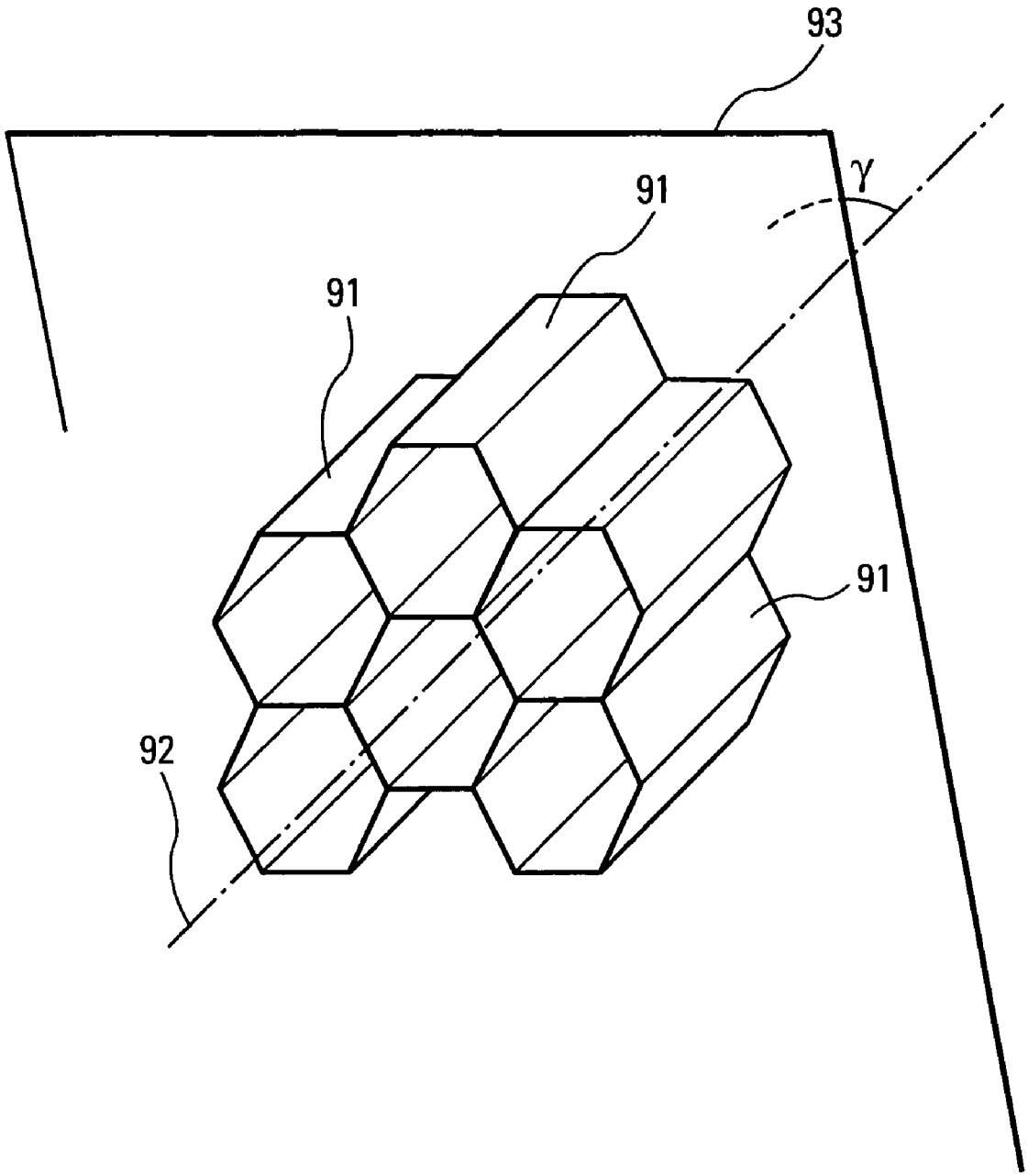
FIG. 9: the illustration of a third embodiment of the module according to the invention.

The illustration of FIG. 9 presents for example another embodiment implementing a volume structure comprising an assembly of conducting blades 91 disposed according to a "honeycomb" type arrangement, the axis 92 of the cells making any angle $\gamma$ defined in particular as a function of the threat considered, with the plane 93 of the wall 52. The angle $\gamma$ may, for example be equal to $\pi/2$. Such a structure, although more complex to embody and possibly heavier than those described in the previous paragraphs has the significant advantage of guaranteeing a substantially constant effectiveness regardless of the direction at which the hollow charge jet penetrates the module.

As was stated previously the assembly of the embodiments that was presented in the previous paragraphs has as characteristic the addition of a lightweight tridimensional structure to the module known from the prior art. As was seen through the various embodiments presented by way of non-limiting examples, this tridimensional structure makes it possible in particular to solve in an effective manner the problem of the traversal of the linermodule by the head 35 of the hollow charge jet, traversed consecutive upon the time of establishment of the jet 34 destruction current. It is therefore of course possible to envisage other embodiments of this tridimensional structure such as for example the structure of a wool consisting of fibres of electrically conducting material or else the structure of a foam of electrically conducting material.

I claim:

1. A module for embodying a lightweight reactive armour plating against hollow charges, a hollow charge producing a jet when it penetrates the armour, the jet comprising a head, said module comprising:

at least one electrically conducting external wall and one electrically conducting internal wall, said walls being spaced from one another and forming two electrodes between which a very high voltage is applied by a power supply, said voltage being large enough to establish in the jet produced by a hollow charge and shorting the two electrodes a current sufficient to heat the jet up to vaporization, said module further comprising an internal tridimensional lightweight mechanical structure, electrically conducting, in electrical contact with an inner surface of the internal wall said structure being configured to cause a quasi-continuous electrical destructive interaction with the head of the hollow charge jet during its penetration inside said structure.

2. The module according to claim 1, wherein the internal tridimensional mechanical structure is made of a plurality of overlaid corrugated conducting sheets, each sheet being separated from the neighbouring sheets by a space of given thickness p and having a side linked electrically to the intermediate wall the sheets being disposed in planes perpendicular to the plane defined by the said internal wall.

3. The module according to claim 2, wherein the planes in which the corrugated conducting sheets are disposed cut the plane formed by the intermediate wall at an angle $\alpha$ of less than $\pi/2$.

4. The module according to claim 1, wherein the internal tridimensional mechanical structure comprises two juxtaposed structures each structure being made of a plurality of overlaid corrugated conducting sheets, each sheet being separated from the neighbouring sheets by a space of given thickness and having a side linked electrically to the intermediate wall, the planes in which the corrugated conducting sheets are disposed cutting the plane formed by the intermediate wall at an angle $\alpha$ of less than $\pi/2$ for the first structure and an angle $\alpha_2$ for the second structure.

5. The module according to claim 4, wherein $\alpha_2=\pi-\alpha_1$.

6. The module according to claim 1, wherein the internal tridimensional mechanical structure exhibits a honeycomb type shape comprising a plurality of cellular ducts made of conducting blades, the said structure being linked electrically to the internal wall, the axis of each cellular duct cutting the plane defined by the intermediate wall at an angle $\gamma$.

7. The module according to claim 6, wherein the angle $\gamma$ is different from $\pi/2$.

8. The module according to claim 1, wherein the energy absorbing internal tridimensional mechanical structure is made of a wool, said wool being made of fibres of electrically conducting material, linked electrically to the intermediate wall.

9. The module according to claim 1, wherein the energy absorbing internal tridimensional mechanical structure is made of a foam of electrically conducting material, electrically linked to the intermediate wall.

10. A device for protection against hollow charges, comprising module elements according to claim 1.

11. A module for embodying a lightweight reactive armour plating against hollow charges, a hollow charge producing a jet when it penetrates the armour, said jet comprising a head, said module comprising at least one electrically conducting external wall and one electrically conducting intermediate wall said walls being spaced from one another and forming two electrodes between which a very high voltage is applied by means of a power supply, said voltage being large enough to establish a current, in the jet produced by a hollow charge and shorting the two electrodes, said current being sufficient to heat the jet up to vaporization, said module further comprising at least one internal tridimensional mechanical structure made of a plurality of overlaid corrugated conducting sheets, each sheet being separated from the neighbouring sheets by a space of given thickness p and having a side linked electrically to the internal side of the intermediate wall, the sheets being disposed in planes perpendicular to the plane defined by the said internal wall.

12. The module according to claim 11, wherein the planes in which the corrugated conducting sheets of an internal tridimensional mechanical structure are disposed cut the plane formed by the intermediate wall at an angle a of less than $\pi/2$.

13. The module according to claim 11, comprising two juxtaposed internal tridimensional mechanical structures, each structure being made of a plurality of overlaid corrugated conducting sheets, each sheet being separated from the neighbouring sheets by a space of given thickness and having a side linked electrically to the intermediate wall, the planes in which the corrugated conducting sheets are disposed cutting the plane formed by the intermediate wall at an angle $\alpha_1$ of less than $\alpha/2$ for the first structure and an angle $\alpha_2$ for the second structure.

14. The module according to claim 13, wherein $\alpha_2=\pi-\alpha_1$.

15. A module for embodying a lightweight reactive armour plating against hollow charges, a hollow charge producing a jet when it penetrates the armour, said jet comprising a head, said module comprising at least one electrically conducting external wall and one electrically conducting intermediate wall said walls being spaced from one another and forming two electrodes between which a very high voltage is applied by means of a power supply, said voltage being large enough to establish a current in the jet produced by a hollow charge and shorting the two electrodes, said current being sufficient to heat the jet up to vaporization, said module further comprising at least an internal tridimensional mechanical structure, said structure exhibiting a honeycomb type shape comprising a plurality of cellular ducts made of conducting blades, the said structure being linked electrically to the internal side of the intermediate wall, the axis of each cellular duct cutting the plane defined by the intermediate wall at an angle $\gamma$.

16. The module according to claim 5, wherein the angle $\gamma$ is different from $\pi/2$.

17. A device for protection against hollow charges, comprising module elements according to claim 11.

* * * * *